US005992654A

United States Patent [19]

Dente, Jr.

[11] Patent Number: 5,992,654

[45] Date of Patent: Nov. 30, 1999

[54] CORNER SHELF

[76] Inventor: Gerald A. Dente, Jr., 98 Hartford St., Natick, Mass. 01760

[21] Appl. No.: 09/126,532

[22] Filed: Jul. 30, 1998

[51] Int. Cl.[6] ..... A47F 5/08

[52] U.S. Cl. ..... 211/90.01

[58] Field of Search ..... 211/90.01, 94.01, 211/153, 90.02, 134, 186

[56] References Cited

U.S. PATENT DOCUMENTS

| | | | |
|---|---|---|---|
| D. 379,412 | 5/1997 | Hampshire | D6/574 |
| 483,069 | 9/1892 | Legg . | |
| 975,619 | 11/1910 | Hollander . | |
| 1,286,588 | 12/1918 | Goodykoontz . | |
| 1,654,409 | 12/1927 | Browne | 211/90.01 |
| 2,182,600 | 12/1939 | Spetz et al. | 211/90.01 |
| 2,219,975 | 10/1940 | Bentz | 211/90.01 |
| 2,261,078 | 10/1941 | Shockey | 211/90 |
| 2,389,349 | 3/1945 | Eastman | 211/134 |
| 2,465,635 | 8/1949 | Conterio | 211/90 |
| 2,828,044 | 3/1958 | Reiss et al. | 220/23.83 |
| 3,033,376 | 5/1962 | Eastman | 211/90 |
| 3,389,349 | 6/1968 | Eastman | 211/90.01 |
| 4,708,310 | 11/1987 | Smith | 211/90.01 |
| 4,886,236 | 12/1989 | Randall | 211/90.01 |
| 5,513,575 | 5/1996 | Slade | 108/42 |
| 5,588,370 | 12/1996 | Longley | 211/90.01 |

*Primary Examiner*—Alvin Chin-Shue
*Assistant Examiner*—Sarah Purol
*Attorney, Agent, or Firm*—Perkins, Smith & Cohen, LLP; Jacob N. Erlich; Jerry Cohen

[57] ABSTRACT

An easily mounted and removable corner shelf having a shelf member, the shelf member having a forward end and a pair of side portions, with the forward end having an opening therein and each of the side portions having a slot therein. A central securing member is slideable within respect to the shelf member and has a pin-like element at the forward end thereof capable of protruding through the opening for embedding within a wall corner in a shelf mounted position. First and second members are pivotally mounted for rotation with respect to the shelf member and are operably interconnected to the central securing member. The first pivotable member having a blade-like element attached thereto and the second pivotable member having a blade-like element attached thereto, each of the blade-like elements protrudable through a respective one of the slots for embedding within adjacent side walls of the corner in the shelf mounted position. Movement of the central securing member in the forward direction moves the first and second pivotable members and the blade-like elements into the shelf mounted position and rearward movement of the central securing member moves the first and second pivotable members and the blade-like elements into a position for removal of the shelf.

23 Claims, 3 Drawing Sheets

CORNER SHELF

BACKGROUND OF THE INVENTION

This invention relates generally to shelves, and, more particularly to an easy to mount and remove corner shelf.

A horizontal support unit such as a corner shelf may be used inside a kitchen cabinet to increase storage capacity. A single shelf or a grouping of shelves may be used in the corner of a room, hallway, or closet as storage or for decorative purposes. Further the corner shelf could be installed in a bookshelf, armoire, or other fine furniture. The uses for such a shelf are numerous, for example, the shelf could receive dolls, plants, spices, toiletries, or any number of other articles.

The installation of a corner shelf, however, is intimidating to the average person due to limited workspace, the use of hand and power tools, the time required to secure the shelf and the mess made during installation. Unsightly brackets or right angle braces are the most common system of support. However, many other attempts at providing corner shelves have been devised, the following patents constitute examples of such attempts: U.S. Pat. Nos. Des. 379,412; 2,261,078; 2,389,349; 2,465,635; 3,033,376; and 5,513,575.

The damage sustained by the receiving corner resulting from the installation of a corner shelf virtually precludes installation in furniture or cabinets and proves to be a strong deterrent for installation in general. Therefore, there appears to be no acceptable easy to install, securely mounted, temporary or portable corner shelf.

Furthermore, corner shelves can be as difficult to remove as they are to install. In the event that a corner shelf is installed a little higher or lower than desired, it would likely be left alone because of these difficulties. Collectively, these problems eliminate the freedom to randomly test corners to find the most suitable or functional place for a corner shelf.

It is therefore the object of this invention to reduce or eliminate the aforementioned problems associated with corner shelf installation.

It is another object of this invention to provide a corner shelf which is capable of being installed in seconds with virtually no mess or tools.

It is a still further object of this invention to provide a corner shelf which is easy to remove and leaves virtually no damage to the corner after being removed therefrom.

It is an even further object of this invention to provide a corner shelf which is easy to manufacture and economical to produce.

SUMMARY OF THE INVENTION

The objects set forth above as well as further and other objects and advantages of the present invention are achieved by the embodiments of the invention described below.

The present invention provides a triangular shaped easily mounted and removable corner shelf which is made up of a shelf top/body, a slidable central securing member and a pair of pivotally mounted side arms having blade-like elements secured thereto. The slidable central securing member and pair of pivotally mounted side arms are operably interconnected to enable the shelf to be securely positioned in a corner. The corner shelf requires no braces or supports to secure it in position in the corner of a room, bookshelf or other type of furniture or the like. It requires no special tools for its installation.

It is the pivotal action of the arms which draws the shelf into the corner with the central securing member having a pin point which embeds itself within the corner. A cam action between the central securing member and arms creates sufficient force which enables the uniquely designed blades of the arms to move forward for installation within the corner walls. In addition, the cammed surfaces interact to maintain these arms in the appropriate securing position and, upon full extension of the central securing member, the arms lock in position and cannot inadvertently retract by pressure or vibration.

The corner shelf of the present invention can be easily removed by moving the central securing member back, which retracts the pin point from the corner of the wall, and the rearward movement of the central securing member enables the arms be withdrawn under the influence of biasing means. The removal of the corner shelf leaves none of the usual holes or marks associated with nails, screws or the like.

For a better understanding of the present invention together with other and further objects thereof, reference is made to the accompanying drawings and the detailed description and its scope will be pointed out in the appending claims.

DETAILED DESCRIPTION OF THE PREFERRED EMBODIMENT

Figure 1:
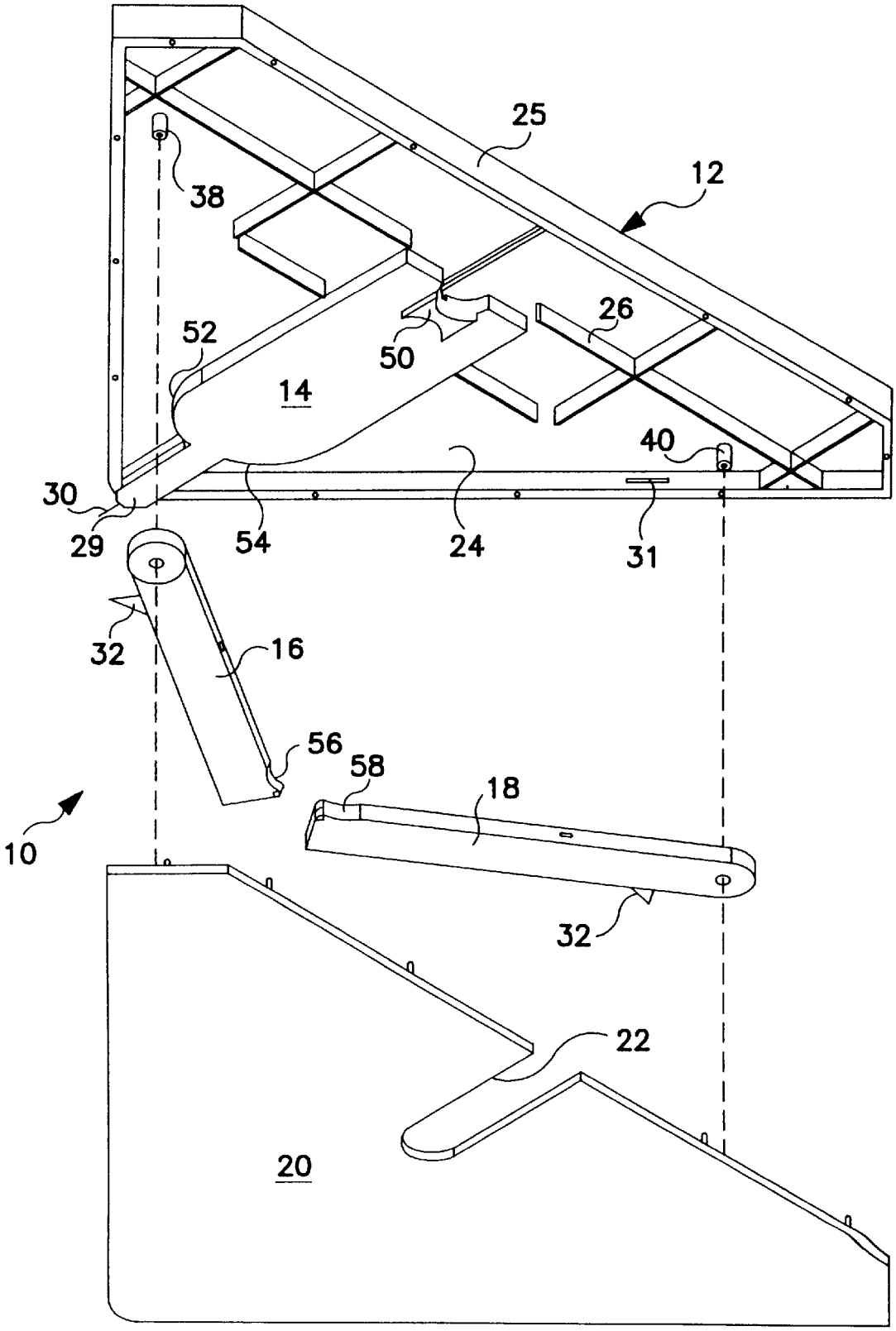
FIG. 1 is a pictorial representation, shown in exploded fashion, of the major components of the corner shelf of the present invention.

FIG. 1 of the drawings shows in exploded fashion the various components making up the easily mounted and removable corner shelf 10 the present invention. Two of the components of the corner shelf 10 the present invention are shown more clearly in pictorial fashion in FIGS. 2 and 3 of the drawings and shelf 10 is then shown in assembled and operational fashion in FIGS. 4 and 5 of the drawings.

More specifically, FIG. 1 of the drawings depicts triangular shelf top/body 12, a slidable central securing member 14, a pair of pivotally mounted side arms 16 and 18, and a base member 20 which contains guide slot 22 therein. The triangular shelf top/body 12 is made of any suitable triangular configuration such that it can easily fit within the corner of abutting side walls of a room, closet, storage area or the like. The triangular shelf top 12 as well as many of the major components thereof are made of any suitable high strength, low cost rigid material such as plastic, wood, or metal. Shelf top/body 12 has an inner or undersurface 24 which is framed by sidewalls 25 and support ribs 26. The sidewalls 25 circumscribe top shelf/body 12 and have formed at the apex thereof a slot or opening 28 clearly shown in FIG. 2. Although not shown in the drawings, the body 12 and base member 20 can have the components thereof interchanged or reversed such that the base member 20 becomes the shelf top and the body 12 becomes the base. However, it is still preferable that the guide slot 22 be located in the base member.

Figure 3:
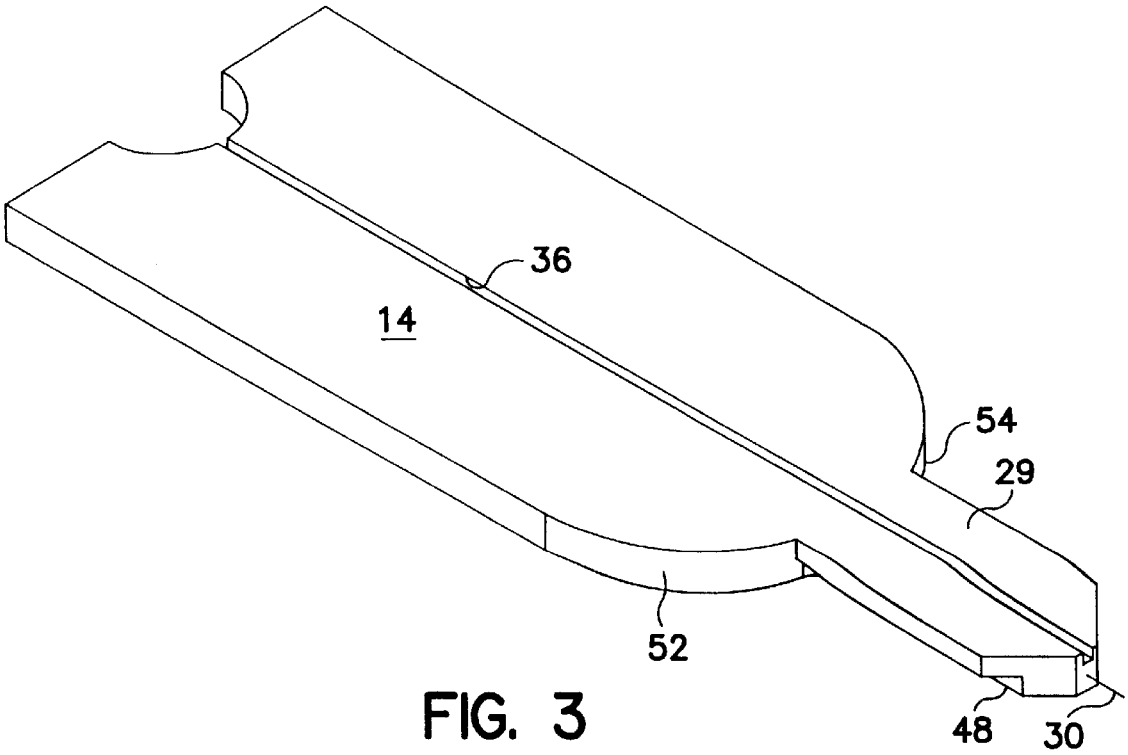
FIG. 3 is a pictorial representation of the slidable central securing member of the corner shelf of the present invention.

As shown in FIG. 3, the front protrusion 29 of central securing member 14 is designed to protrude from slot 28 and pass its sharpened pin-point 30 therethrough. Further explanation of the shelf mounting operation of the central securing member 14 in conjunction with the pivotal arms 16 and 18 will be explained in detail with respect to FIGS. 4 and 5 of the drawings. In addition to the central slot 28 in sidewalls 25, a pair of sidewalls each contain a blade slot 31 therein to receive angular blade 32 affixed to the pivotal arms 16 and 18, respectively.

Included in the inner surface of the triangular shelf top/body 12 are a series of support ribs 26 to form a reinforcing frame which not only acts to strengthen the triangular shelf top/body 12 but also act as a guide for the central securing member 14. Also included on the inner surface of the triangular shelf top/body 12 is a guide rib 34 which operates in conjunction with a guide slot 36 located on the inner surface of central securing member 14.

Figure 2:
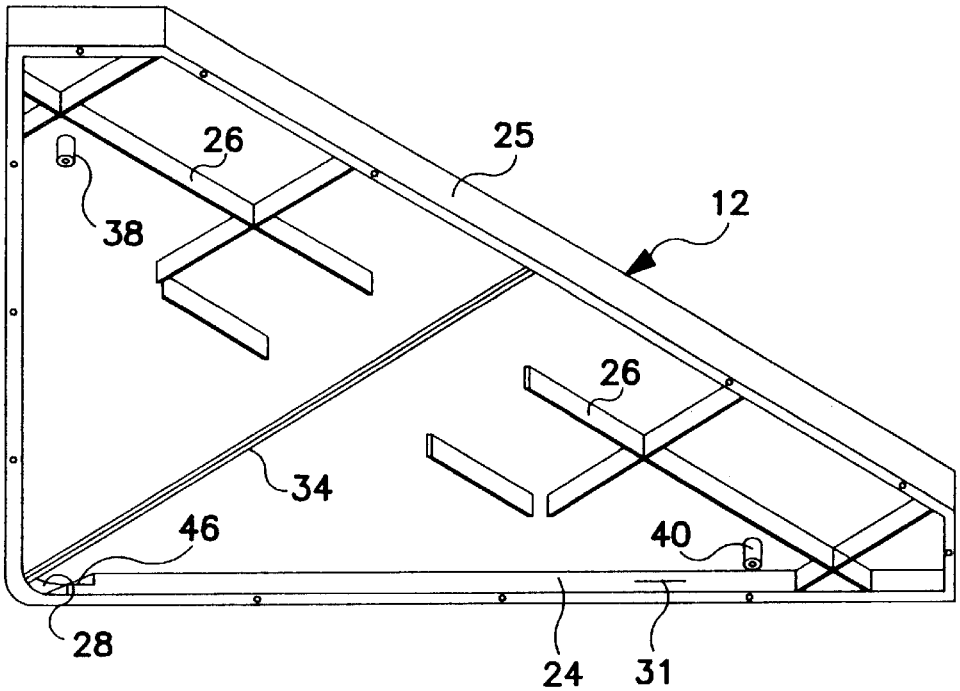
FIG. 2 is a pictorial representation of the shelf top/body of the corner shelf of the present invention.
Figure 4:
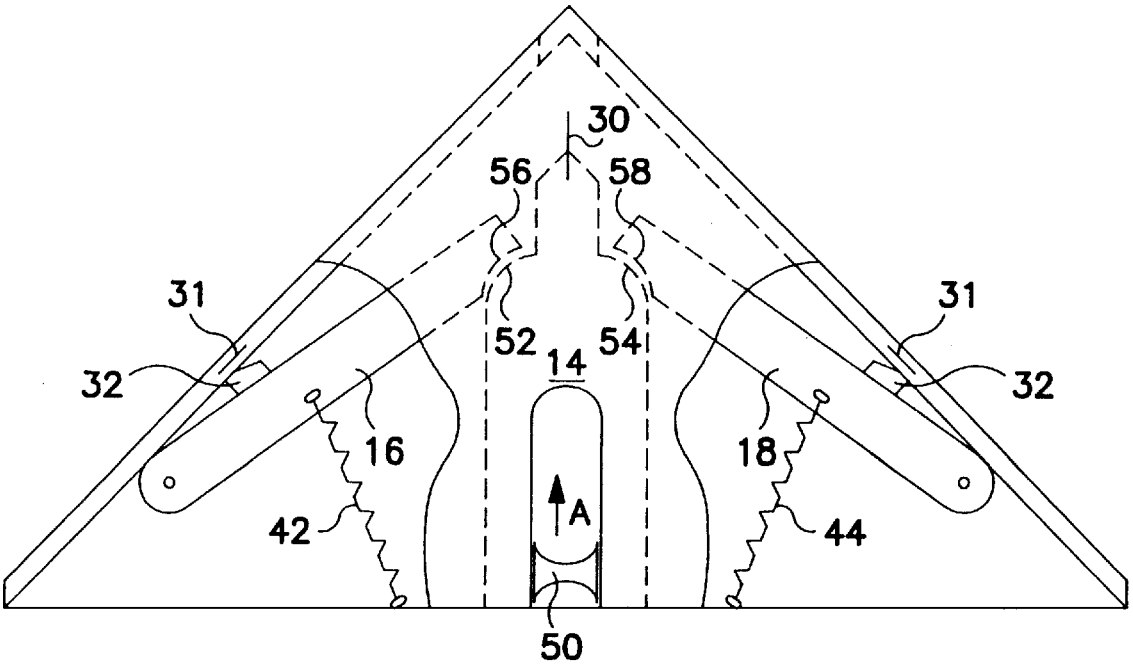
FIG. 4 is a pictorial representation of the corner shelf of the present invention shown in its inoperable position.

As more clearly shown in FIG. 2 of the drawings, the inner surface of triangular shelf top/body 12 also includes pivot members 38 and 40 which are utilized to pivotally mount pivotal arms 16 and 18, respectively, to shelf top/body 12. The pivotal members 16 and 18 are biased to a retracted position as shown in FIG. 4 by any suitable biasing members 42 and 44, respectively. The movement of pivot members 16 and 28 from a retracted position (FIG. 4) to an operative position (FIG. 5) will be explained in further detail hereinbelow.

Referring once again to FIG. 2, a stepped guide 46 encompasses central slot 28 to maintain the alignment of central securing member 14 by interacting with the stepped surface 48 of front protrusion 29. This alignment is reinforced by the interrelationship between the guide slot 36 on the bottom surface of central securing member 14 with guide rib 34. The outer surface of the central securing member 14 has a lock slide 50 thereon which is clearly shown in FIG. 1 of the drawings. The lock slide 50 can be operated by the thumb or other fingers of a user in a manner to be described below. The lock slide 50 is configured to slideably move within the guide slot 22 of base member 20 as shown in FIG. 1 of the drawings.

In addition, the central securing member 14 has a pair of cam surfaces 52 and 54 thereon which engage the curved follower surfaces 56 and 58 located on each of the pivotal arms 16 and 18, respectively. The pin point 30 protruding from front protrusion 29 is utilized to embed itself within the corner of a wall, while each of the pivotal arms 16 and 18 have angular blade members 32 slice into the sides of a corner to hold the shelf in its useful position.

Figure 5:
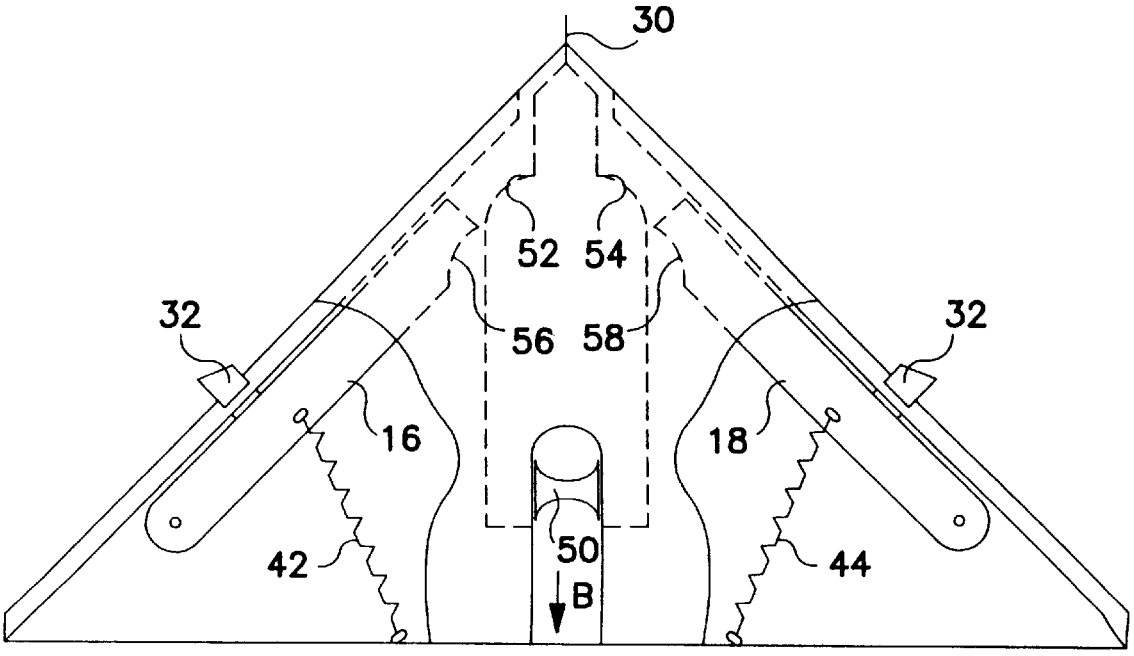
FIG. 5 is a pictorial representation of the corner shelf of the present invention shown in its operable position.

Referring to FIGS. 4 and 5 of the drawings, each of the pivotal arms 16 and 18 are biased to the retracted position by means of biasing members 42 and 44, respectively. These biasing members 42 and 44 are interconnected between respective arms 16 and 18 and the base of the triangular shelf top/body 12 so as to maintain arms 16 and 18 in their retracted position. This aspect of the present invention is clearly shown in FIG. 4 of the drawings wherein arms 16 and 18 are shown retracted along with the central securing member 14. The retracted position of arms 16 and 18 and central securing member 14 prevents the sharp pin point 30 and blades 32 from injuring a user and while awaiting placement within the corner of a room, closet or the like. Each of the blades 32 and 34, respectively, are configured such that the sharpened point of the blade engages the wall into which it embeds first. The downward angle assists securement of the shelf against the corner of a room, closet or the like.

As shown in FIG. 5 of the drawings, activation of the central securing member 14 takes place by movement of the lock slide 52 in the direction of the arrow A in FIG. 4 of the drawings. This movement of lock slide 50 causes the central securing member 14 to move to the position shown in FIG. 5, wherein the cam surfaces 52 and 54 act against the cam follower surfaces 56 and 58 on each of the arms 16 and 18, respectively.

As the central securing member 14 moves to its position as shown in FIG. 5 of the drawings, the pin point of the securing member 14 embeds itself in the corner of a wall while the angular blades 32 and 34 slice into the sides of the wall thereby fixably securing the shelf 10 in place. The cammed surfaces interact to maintain these arms in the position shown in FIG. 5 of the drawings and this arrangement creates a secure engagement of the shelf 10 within a corner of a room, closet or the like. More specifically, upon full extension of the central securing member 14 (see FIG. 5) the arms 16 and 18 glide over and past the cam surfaces 52 and 54 onto the flat surface adjacent thereto, locking the arms in place so that they do not inadvertently retract as a result of unwanted pressure or vibration.

The flat surfaces of the angular blades 32 prevent the shelf top/body 12 from tipping and together with pin point 30 securely holds shelf 10 in place. Removal of the shelf is accomplished by moving the slide lock 50 back in the direction of Arrow B (FIG. 5), therefore retracting the pin-point 30 and blades 32 from the wall. Such retraction of members 62 and 64 is once again shown in FIG. 4 of the drawings The shelf 10 of the present invention requires no additional braces or supports, no nails or screws, no tape or glue, no suction cups or special tools for its installation. The pivotal action of arms 16 and 18 actually draws the shelf 10 into the corner. The cam action of the central securing member 14 with arms 16 and 18 creates as much as 4 to 1 leverage advantage. The shape of the blades 32 with its flat side prohibits forward moving of the shelf once it is installed. The angled side of the blades 32 permit its easy installation. The blade offers superior strength and stability and won't bend, therefore the shelf 10 remains in an extremely stable position against the corner of a wall, closet or other components. Furthermore withdrawal of these blades 32 leaves and pin point 30 virtually no marks within the walls after its use and disassembly.

To install the shelf 10 in its appropriate position, one merely has to take the shelf, position it against a wall, and move the slide lock 50 forward. This instantly attaches the shelf 10 to the wall with no braces or support from above or below, with no nails or screws, no double faced taped or glue and no suction cups. In fact, it appears that the shelf 10 actually defies gravity, since the blade 32 create an extremely strong supporting action for the shelf. To disengage the shelf from the wall, simply move the lock slide 50 back to free the shelf from the wall leaving none of the usual holes or marks associated with nails, screws or the like.

Although the invention has been described with respect to various embodiments, it should be realized this invention is also capable of a wide variety of further and other embodiments within the spirit and scope of the appended claims.

What is claimed is:

1. An easily mounted and removable corner shelf comprising:

a shelf member, said shelf member having a forward end and a pair of side portions;

said forward end having an opening therein and each of said side portions having a slot therein;

a central securing member slideable with respect to said shelf member, said central securing member having a pin-like element at the forward end thereof, said pin-like element capable of protruding through said opening for embedding within a wall corner in a shelf mounted position;

first and second members, said first and said second members being pivotally mounted for rotation with respect to said shelf member and operably interconnected to said central securing member, said first pivotable member having a blade-like element attached thereto and said second pivotable member having a blade-like element attached thereto, each of said blade-like elements protrudable through a respective one of said slots for embedding within adjacent side walls of the corner in the shelf mounted position;

wherein forward movement of said central securing member moves said first and second pivotable members and said blade-like elements into the shelf mounted position.

2. The easily mounted and removable corner shelf as defined in claim 1 wherein said central securing member has a pair of cam-like surfaces thereon and adjacent straight portions, said first and said second members each having a cam follower surface thereon for engagement with said cam-like surfaces, wherein said forward movement of said central securing member into the shelf mounted position moves said first and second pivotable members and said blade-like elements into the shelf mounted position and said straight portions of said central securing member acts in conjunction with said first and second pivotable members to prevent any substantial unwanted movement thereof.

3. The easily mounted and removable corner shelf as defined in claim 2 further comprising means operably connected between said first and said second pivotable members and said shelf member for biasing said first and said second pivotable members against said central securing member.

4. The easily mounted and removable corner shelf as defined in claim 3 wherein each of said blade-like members has a first side of preselected length and a second side of a length shorter than said preselected length to form an edge of angular configuration in which the side of shorter length is closest to the corner of the wall in the shelf mounted position.

5. The easily mounted and removable corner shelf as defined in claim 3 wherein one side of said shelf member has a guide slot therein and said central securing member includes a raised component movable within said guide slot for use in moving said central securing member.

6. The easily mounted and removable corner shelf as defined in claim 3 wherein said shelf member has a guide rib therein and said central securing member has a guide slot therein for engagement with said guide rib.

7. The easily mounted and removable corner shelf as defined in claim 5 wherein said raised component is utilized to (a) move said central securing member forward to the shelf mounted position and (b) move said central securing member backward to remove said central securing member from the shelf mounted position, wherein said biasing means causes said first and second pivotable members to disengage said blade-like elements from the adjacent side walls.

8. The easily mounted and removable corner shelf as defined in claim 7 wherein send shelf member comprises:

a shelf top and a base;

said shelf top having said central securing member and said first and second pivotal members operably attached thereto; and said base having said guide slot therein.

9. The easily mounted and removable corner shelf as defined in claim 8 wherein said shelf top includes a plurality of supporting ribs.

10. The easily mounted and removable corner shelf as defined in claim 8 wherein said opening is located within the front end of said shelf top and said opening has a step-like internal configuration, said forward end of said central securing member having a configuration which matingly configures with said step-like configuration of said opening.

11. The easily mounted and removable corner shelf as defined in claim 10 wherein said biasing means is a spring.

12. The easily mounted and removable corner shelf as defined in claim 10 wherein said biasing means is a made of an elastic material.

13. An easily mounted and removable corner shelf comprising:

a shelf member having a forward end, said shelf member having a top portion, a base and a pair of side portions between said top portion and said base;

said forward end having an opening at an intersection of said side portions, and each of said side portions having a slot therein;

a central securing member slideable with said shelf member, said central securing member having a pin-like element at the forward end thereof, said pin-like element capable of protruding through said opening for embedding within a wall corner in a shelf mounted position;

first and second members, said first and said second members being pivotally mounted for rotation within said shelf member and operably interconnected to said central securing member, said first pivotable member having a blade-like element attached thereto and said second pivotable member having a blade-like element attached thereto, each of said blade-like elements protrudable through a respective one of said slots for embedding within adjacent side walls of the corner in the shelf mounted position;

wherein forward movement of said central securing member moves said first and second pivotable members and said blade-like elements into the shelf mounted position.

14. The easily mounted and removable corner shelf as defined in claim 13 wherein said central securing member has a pair of cam-like surfaces thereon and adjacent straight portions, said first and said second members each having a cam follower surface thereon for engagement with said cam-like surfaces, wherein said forward movement of said central securing member into the shelf mounted position moves said first and second pivotable members and said blade-like elements into the shelf mounted position and said straight portions of said central securing member acts in conjunction with said first and second pivotable members to prevent any substantial unwanted movement thereof.

15. The easily mounted and removable corner shelf as defined in claim 14 further comprising means operably connected between said first and said second pivotable members and said shelf member for biasing said first and said second pivotable members against said central securing member.

16. The easily mounted and removable corner shelf as defined in claim 13 wherein each of said blade-like members has a first side of preselected length and a second side of a length shorter than said preselected length to form an edge of angular configuration in which the side of shorter length is closest to the corner of the wall in the shelf mounted position.

17. The easily mounted and removable corner shelf as defined in claim 15 wherein each of said blade-like members has a first side of preselected length and a second side of a length shorter than said preselected length to form an edge of angular configuration in which the side of shorter length is closest to the corner of the wall in the shelf mounted position.

18. The easily mounted and removable corner shelf as defined in claim 17 wherein said base of said shelf member has a guide slot therein and said central securing member includes a raised component movable within said guide slot for use in moving said central securing member.

19. The easily mounted and removable corner shelf as defined in claim 18 wherein said top portion of said shelf member has a guide rib therein and said central securing member has a guide slot therein for engagement with said guide rib.

20. The easily mounted and removable corner shelf as defined in claim 19 wherein said raised component is utilized to (a) move said central securing member forward to the shelf mounted position and (b) move said central securing member backward to remove said central securing member from the shelf mounted position, wherein said biasing means causes said first and second pivotable members to disengage said blade-like elements from the adjacent side walls.

21. An easily mounted and removable corner shelf comprising:

a shelf member, said shelf member having a forward end, a pair of side portions and a rear end;

said forward end having an opening therein and each of said side portions having an opening therein;

an actuation mechanism within said shelf member movable with respect to said shelf member;

a pin-like element associated with said actuation mechanism and located at said forward end of said shelf member, said pin-like element capable of protruding through said opening in said forward end of said shelf member for embedding within a wall corner in a shelf mounted position; and first and second members, said first and said second members being movably mounted with respect to said shelf member and operably interconnected to said actuation mechanism, said first member having a blade-like element attached thereto and said second member having a blade-like element attached thereto, each of said blade-like elements having a first straight side and a second angled side with respect to said straight side, said angled side being positioned toward said forward end of said shelf and said straight side being positioned toward said rear end, each of said blade-like elements capable or protruding through a respective one of said openings in said side portions for embedding within adjacent side walls of the corner in the shelf mounted position;

wherein movement of said actuation mechanism moves said pin-like element and said blade-like elements into the shelf mounted position.

22. The easily mounted and removable corner shelf as defined in claim 21 wherein each of said straight sides of said blade-like elements is positioned substantially perpendicular to a respective one of said side portions when said blade-like elements are in the shelf mounted position.

23. The easily mounted and removable corner shelf as defined in claim 1 wherein each of said blade-like elements has a first straight side and a second angled side with respect to said straight side, said angled side being positioned closer toward said forward end of said shelf and said straight side being positioned further from said forward end of said shelf.

* * * * *